US008991289B2

(12) United States Patent
Gerhardt

(10) Patent No.: US 8,991,289 B2
(45) Date of Patent: Mar. 31, 2015

(54) METHOD FOR THE SLICING OF FOOD PRODUCTS

(75) Inventor: Markus Gerhardt, Biedenkopf (DE)

(73) Assignee: Weber Maschinenbau GmbH Breidenbach (DE)

( * ) Notice: Subject to any disclaimer, the term of this patent is extended or adjusted under 35 U.S.C. 154(b) by 288 days.

(21) Appl. No.: 13/445,463

(22) Filed: Apr. 12, 2012

(65) Prior Publication Data

US 2013/0025420 A1 Jan. 31, 2013

(30) Foreign Application Priority Data

Apr. 15, 2011 (DE) ..... 10 2011 017 227

(51) Int. Cl.

| | |
|---|---|
| ***B26D 1/00*** | (2006.01) |
| ***B26D 7/08*** | (2006.01) |
| ***B26D 3/30*** | (2006.01) |
| *B26D 1/15* | (2006.01) |
| *B26D 7/06* | (2006.01) |

(52) U.S. Cl.

CPC ... *B26D 7/08* (2013.01); *B26D 1/15* (2013.01); *B26D 3/30* (2013.01); *B26D 7/0625* (2013.01); *B26D 2210/02* (2013.01)

USPC ..... 83/34; 83/49; 83/401; 83/617; 83/663

(58) Field of Classification Search

USPC ..... 83/350, 351, 354, 356, 356.2, 932, 34, 83/49, 401, 459, 494, 493, 492, 491, 663, 83/664, 665, 666, 617

See application file for complete search history.

(56) References Cited

U.S. PATENT DOCUMENTS

| | | | | |
|---|---|---|---|---|
| 3,824,885 | A * | 7/1974 | Marshall et al. | 83/19 |
| 4,428,263 | A * | 1/1984 | Lindee et al. | 83/354 |
| 5,649,463 | A * | 7/1997 | Lindee et al. | 83/174 |
| 5,974,925 | A * | 11/1999 | Lindee et al. | 83/412 |
| 5,988,033 | A * | 11/1999 | Skaar et al. | 83/596 |
| 6,267,033 | B1 * | 7/2001 | Gundlach et al. | 83/42 |
| 6,935,215 | B2 * | 8/2005 | Lindee et al. | 83/74 |
| 7,451,676 | B2 * | 11/2008 | Thurston et al. | 83/409.1 |
| 8,166,856 | B2 * | 5/2012 | Kim et al. | 83/13 |
| 8,616,103 | B2 * | 12/2013 | Lindee et al. | 83/469 |
| 2002/0005102 | A1 | 1/2002 | Takemura et al. | |

FOREIGN PATENT DOCUMENTS

| | | |
|---|---|---|
| DE | 19949459 A1 | 4/2001 |
| DE | 69621134 T2 | 11/2002 |
| DE | 20306658 U1 | 6/2004 |
| DE | 10305874 A1 | 8/2004 |
| DE | 10309552 | 9/2004 |

(Continued)

OTHER PUBLICATIONS

German Search Report of German Application No. DE102011017227.0; Filing Date Apr. 15, 2011; Mailing Date Mar. 13, 2012, 5 pages and English Translation.

*Primary Examiner* — Omar Flores Sanchez
(74) *Attorney, Agent, or Firm* — Cantor Colburn LLP

(57) ABSTRACT

In a method for slicing food products, a cutting blade carries out a primary movement defining a cutting plane and a product to be sliced is supplied to the cutting blade by means of a conveying device to bring the product into engagement with the cutting blade. The cutting blade moved is from time to time at a speed different from the speed of the primary movement while it is in engagement with the product.

6 Claims, 1 Drawing Sheet

(56) References Cited

FOREIGN PATENT DOCUMENTS

| | | | |
|---|---|---|---|
| DE | 69829043 | T2 | 2/2006 |
| EP | 1445077 | A1 | 8/2004 |
| EP | 1466709 | A2 | 10/2004 |
| EP | 2082854 | A1 | 7/2009 |
| GB | 2070419 | A | 9/1981 |
| JP | 02218596 | A | 8/1990 |
| JP | 03277497 | A | 12/1991 |
| JP | 05023996 | A | 2/1993 |
| JP | 07132493 | A | 5/1995 |

* cited by examiner

METHOD FOR THE SLICING OF FOOD PRODUCTS

CROSS-REFERENCE TO RELATED APPLICATIONS

This patent application claims the benefit of priority to German Patent Application Serial No. 102011017227.0, filed Apr. 15, 2011, which is incorporated herein by reference in its entirety.

FIELD OF THE INVENTION

The present invention relates to a method for slicing food products, and more particularly for dividing stacks of individual food product slices, wherein a cutting blade carries out a primary movement defining a cutting plane and a product to be sliced is supplied to the cutting blade by a conveying device to bring the product into engagement with the cutting blade.

BACKGROUND

Food products such as meat, sausage or cheese have to be sliced in various manners in the food processing industry. Cutting apparatuses such as high-performance slicers serve, for example, to cut off product slices from a product loaf or a product bar at a high cutting frequency. The individual slices cut off can be supplied in stacked or overlapping form to a subsequent processing device, for example to a packaging machine. It is desired in specific applications to divide the product slice stacks before the further processing, that is to cut through them in the stack direction.

There is in particular a problem with such a dividing of stacks of individual product slices that individual product slices are displaced or raised due to an adhesive effect between the cutting blade surface and the product and the predefined shape of the stack is thus impaired. This problem of the part co-moving of individual product slices in accordance with the primary movement of the cutting blade occurs in pronounced form when film layers or paper layers are located between the product slices. Product parts can also be displaced in an unwanted manner in ultrasound cutting.

It is a feature of the invention to achieve a higher cutting quality on the slicing of food products and to prevent an unwanted co-movement of product parts with the cutting blade.

BRIEF DESCRIPTION OF THE INVENTION

The above-referenced feature is provided by a method for slicing food products, wherein a cutting blade carries out a primary movement defining a cutting plane and a product to be sliced is supplied to the cutting blade by a conveying device to bring the product into engagement with the cutting blade. The cutting blade is moved from time to time at a speed different from the speed of the primary movement while it is in engagement with the product. The effect of the taking along of product slices by the cutting blade can be reduced by such a speed variation during the cutting process. The speed can in this respect be varied both in amount and in direction.

The cutting blade can be moved against the primary movement from time to time while it is in engagement with the product. A co-moving of a product slice by the primary movement of the cutting blade is compensated by such a counter-movement of the cutting blade during the cutting process, whereby the cutting quality is improved and a displacement or raising of product slices in a stack can be avoided.

The cutting blade can also be decelerated and/or accelerated while it is in engagement with the product. A deceleration or acceleration can also occur in combination with a change of direction. In the sense of a continuous cutting operation, the cutting blade can in particular be alternately decelerated and accelerated again.

The cutting blade may be moved in a swinging or oscillating manner in the cutting plane while it is in engagement with the product. A particularly high cutting quality can be achieved by such an oscillation movement. A self-cleaning effect of the cutting blade results as an additional advantage. The oscillation frequency can be selected to be so high that a change from taking-along movement and compensation movement takes place so fast that it remains substantially unnoticed by the product slices and a product slice movement is at least approximately completely avoided on cutting.

In accordance with an embodiment of the invention, the cutting blade is moved about a blade axis rotating in the cutting plane, with the direction of rotation of the rotational movement being changed while the cutting blade is in engagement with the product. In this embodiment, the primary movement of the cutting blade is therefore a rotational movement in a primary direction of rotation. The cutting blade can be set into a rotational oscillation by repeated changing of the direction of rotation. This is possible with, for example, a suitable control of a motor driving the cutting blade. The rotatable cutting blade can in this respect be formed as a circular blade or as a segment blade.

In accordance with an aspect of the invention, the cutting blade is alternately rotated about a first angle of rotation in accordance with the primary movement and about a second angle of rotation against the primary movement, with the first angle of rotation being larger than the second angle of rotation. Averaged over a longer time period, the cutting blade therefore carries out a total rotation in the direction of the primary movement, with recurring phases of a counter-rotation occurring, however. The angles of rotation can be selected in dependence on the respective application. Care must only be taken that a cutting edge of the cutting blade is in engagement with the product on the reversal of the direction of rotation.

The product may be supplied to the cutting blade in that the product is moved toward the cutting blade by means of a product conveyor in a conveying direction extending parallel to the cutting plane. The cutting blade therefore does not have to carry out any further movement of its own apart from the primary movement and the movement opposite hereto since the product is supplied to the corresponding cutting edge of the cutting blade by means of the product conveyor. If the application should require, the cutting blade can, however, also be moved relative to the product in addition to the primary movement and to the movement opposite hereto, i.e. it can, for example, be lowered onto the product as a rotating circular blade or as a circular blade revolving in a planetary motion.

An embodiment of the invention also relates to an apparatus for slicing food products, in particular for dividing stacks of individual food products, having a cutting blade, a drive to set the cutting blade into a primary movement defining a cutting plane and a conveying device to supply a product to be sliced to the cutting blade and to bring the product into engagement with the cutting blade.

In accordance with an embodiment of the invention, the drive is designed to move the cutting blade from time to time at a speed different from the speed of the primary movement while it is in engagement with the product. The drive can in particular be designed to move the cutting blade against the primary movement from time to time while it is in engagement with the product. A variation of the speed and in particular a change of the direction of movement can be effected, for example, in that a motor of the drive is controlled accordingly.

In accordance with an embodiment, the conveying device is designed to move the product toward the cutting blade in a conveying direction extending parallel to the cutting plane. Such an apparatus can in particular serve to divide a continuously conveyed stream of product stacks before a further processing, e.g. to cut it into two stack halves of equal size.

The conveying device can, for example, include a continuously operating product conveyor, in particular a belt conveyor or strip conveyor. The dividing of the product stacks can thus take place in a flow.

In accordance with an aspect of the invention, the primary movement is a rotational movement of the cutting blade about a blade axis. The cutting blade can in particular be a circular blade or a segment blade. In accordance with an aspect of the invention, the cutting blade is a sawing blade, i.e. the cutting edge of the cutting blade has a toothed arrangement at least sectionally.

The invention will be described in the following by way of example with reference to the drawings.

DETAILED DESCRIPTION

Figure 1:
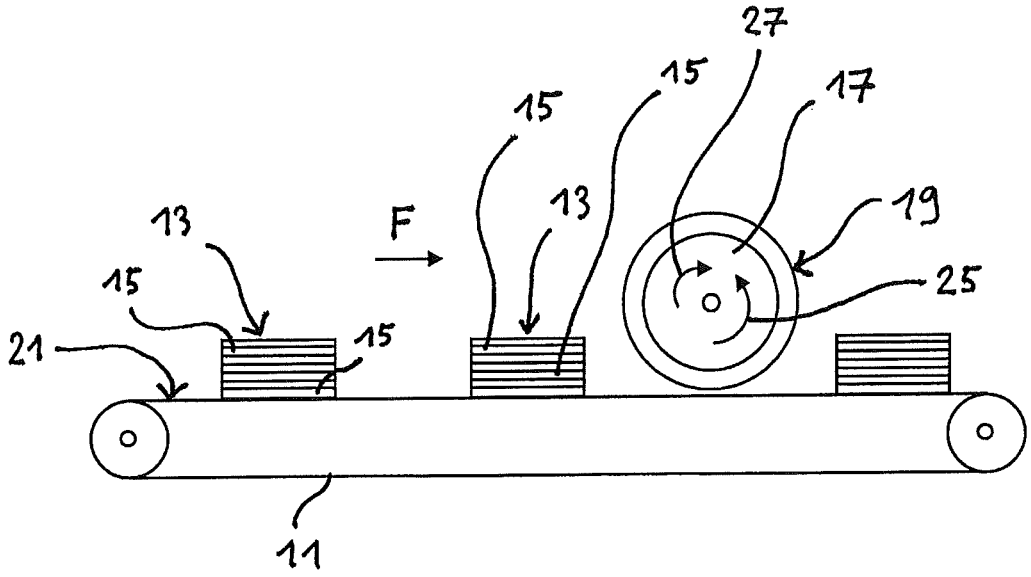
FIG. 1 is a simplified side view of an apparatus in accordance with the invention for slicing food products.
Figure 2:
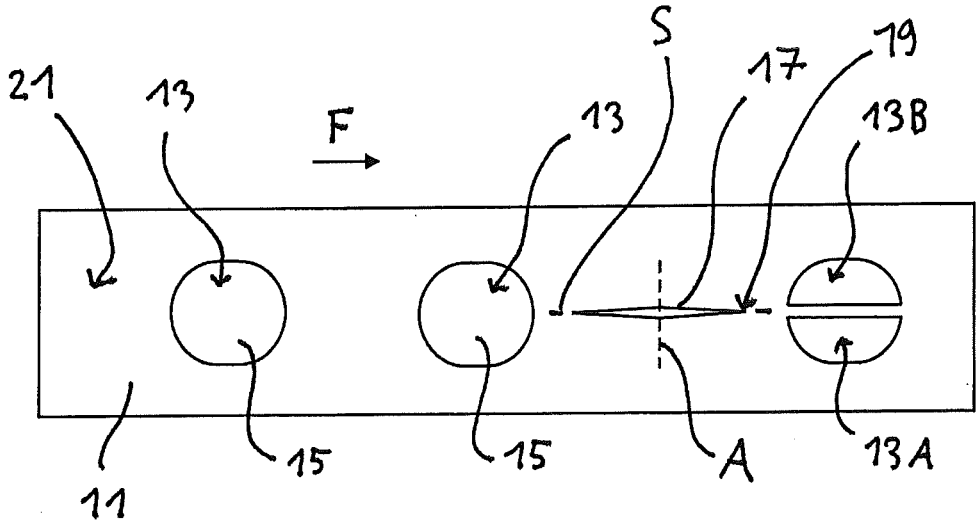
FIG. 2 shows a plan view of the apparatus in accordance with FIG. 1.

The apparatus shown in FIGS. 1 and 2 for slicing food products includes a continuous belt conveyor 11 on which product stacks 13 of individual product slices 15 lie. The product slices 15 can, for example, be sausage slices or cheese slices. The continuous belt conveyor 11 guides the product stack 13 in a continuous stream along a conveying direction F to a cutting blade 17. The apparatus shown can be integrated into a larger food production plant and can in particular be arranged after a high-performance slicer which produces the individual product slices 15 by cutting off from a product loaf or product bar. The slicing apparatus can in particular be arranged at a feeder of a production plant.

The cutting blade 17 is formed as a circular blade rotating about a horizontal blade axis A (FIG. 2) and has a peripheral cutting edge 19. The cutting edge 19 defines a cutting plane S which is arranged at right angles to a support surface 21 of the continuous belt conveyor 11 and parallel to the conveying direction F. On the movement along the conveying direction F, the product stacks 13 move to the cutting edge 19 which rotates in accordance with a primary movement 25 (counter-clockwise in FIG. 1) so that ultimately the cutting edge 19 cuts through the product stack 13. The product stack 13 is in this manner divided into two stack halves 13A, 13B which are conveyed onward by the continuous belt conveyor 11 and are subsequently supplied to a packaging machine which packs the two stack halves 13A, 13B together or separately.

To increase the cutting quality and to avoid a displacement or raising of individual product slices 15 on the cutting through of a product stack 13, the cutting blade 17 is set into a counter-movement 27 (clockwise in FIG. 1) directed against the primary movement 25 at recurring intervals, such as regular intervals. In other words, the cutting blade 17 carries out an oscillating movement or a movement swinging in the peripheral direction overall. The cutting blade 17 can specifically be rotated alternately about a first angle of rotation in the direction of the primary movement 25 and about a second angle of rotation in the direction of the counter-movement 27, with the first angle of rotation being larger than the second angle of rotation. The changing of the direction of rotation of the cutting blade 17 can take place, for example, by means of a suitable control of a rotary drive (not shown) associated with the cutting blade 17.

The product stacks 13 can be cut through particularly cleanly by the oscillating rotational movement of the cutting blade 17, with a displacement or raising of individual product slices 15 being avoided in that a possible taking-along movement is compensated again by a counter-movement. The oscillation movement may take place so fast that neither a taking-along movement nor a compensation movement of the product slices 13 can be detected due to inertia effects.

The movement of the cutting blade from time to time against the primary movement during the cut guidance is particularly suitable for cutting through stacks of individual product slices, such as when they are separated from one another by paper layers or film layers. The slicing principle in accordance with embodiments of the invention can generally, however, also increase the cutting quality on the slicing of contiguous product pieces, for example on a cutting of product slices from a product bar. A self-cleaning effect also results as an additional advantage due to the oscillation movement of the cutting blade.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A method for slicing food products comprising:

carrying out a primary movement with a cutting blade defining a cutting plane;

supplying a product to be sliced to the cutting blade by a conveying device to bring the product into engagement with the cutting blade;

moving the cutting blade from time to time at a speed different from the speed of the primary movement while it is in engagement with the product;

moving the cutting blade about a blade axis rotating in the cutting plane, with the direction of rotation of the rotational movement being changed while the cutting blade is in engagement with the product; and rotating the cutting blade alternately about a first angle of rotation in accordance with the primary movement and about a second angle of rotation against the primary movement, with the first angle of rotation being larger than the second angle of rotation.

2. A method in accordance with claim 1, wherein the cutting blade is moved from time to time against the primary movement while it is in engagement with the product.

3. A method in accordance with claim 1, wherein the cutting blade is decelerated and/or accelerated while it is in engagement with the product.

4. A method in accordance with claim 1, wherein the cutting blade is moved in a swinging or oscillating manner in the cutting plane while it is in engagement with the product.

5. A method in accordance with claim 1, wherein, during the supply of said product to the cutting blade, the product is moved toward the cutting blade by a product conveyor in a conveying direction extending parallel to the cutting plane.

6. A method in accordance with claim 1, wherein the product is a stack of individual food product slices and the cutting blade is arranged to divide the stack.

* * * * *